US009322086B2

(12) United States Patent
Speckert et al.

(10) Patent No.: US 9,322,086 B2
(45) Date of Patent: Apr. 26, 2016

(54) ALUMINUM PRESSURE CASTING ALLOY

(71) Applicants: Georg Fischer Druckguss GmbH & Co KG, Herzogenburg (AT); Georg Fischer GmbH & Co KG, Altenmarkt, St. Gallen (AT)

(72) Inventors: Leif Speckert, Gottlieben (CH); Stuart Wiesner, Schaffhausen (CH)

(73) Assignees: Georg Fischer Druckguss GmbH & Co KG, Herzogenburg (AT); Georg Fischer GmbH & Co KG, St. Gallen (AT)

( * ) Notice: Subject to any disclaimer, the term of this patent is extended or adjusted under 35 U.S.C. 154(b) by 17 days.

(21) Appl. No.: 14/083,990

(22) Filed: Nov. 19, 2013

(65) Prior Publication Data

US 2014/0140886 A1 May 22, 2014

(30) Foreign Application Priority Data

Nov. 21, 2012 (EP) ..... 12193547

(51) Int. Cl.

| | |
|---|---|
| ***C22C 21/02*** | (2006.01) |
| ***C22C 21/04*** | (2006.01) |
| ***C22F 1/043*** | (2006.01) |
| ***B22D 21/00*** | (2006.01) |

(52) U.S. Cl.

CPC ..... *C22C 21/02* (2013.01); *B22D 21/007* (2013.01); *C22C 21/04* (2013.01); *C22F 1/043* (2013.01)

(58) Field of Classification Search

CPC ..... C22C 21/02; C22C 21/04; C22F 1/043

See application file for complete search history.

(56) References Cited

U.S. PATENT DOCUMENTS

| | | | | |
|---|---|---|---|---|
| 7,108,042 | B2 * | 9/2006 | Koch | C22C 1/06 164/113 |
| 2003/0136477 | A1 | 7/2003 | Kitaoka et al. | |
| 2005/0167012 | A1 * | 8/2005 | Lin | C22F 1/043 148/549 |
| 2012/0148444 | A1 | 6/2012 | Nagaishi et al. | |

FOREIGN PATENT DOCUMENTS

| | | | |
|---|---|---|---|
| DE | 102010055011 | A1 * | 6/2012 |
| EP | 0997550 | A1 | 5/2000 |
| EP | 1331281 | A1 | 7/2003 |

OTHER PUBLICATIONS

W. Hufnagel et al., "Aluminium-Taschenbuch 14th Edition", Aluminium-Verlag Düsseldorf, 1988, p. 44ff. ISBN 3-87017-169-3.

* cited by examiner

*Primary Examiner* — Roy King
*Assistant Examiner* — Janelle Morillo
(74) *Attorney, Agent, or Firm* — Bachman & LaPointe, P.C.

(57) ABSTRACT

Aluminum alloy for components having increased strength with a yield point $Rp_{0.2}$>120 MPa and at the same time an elongation at break A>7% in the cast state, a yield point $Rp_{0.2}$>200 MPa and at the same time an elongation at break A>6% after a T5 heat treatment or a yield point $Rp_{0.2}$>200 MPa and at the same time a high elongation at break A>9% after a T6 heat treatment, in particular for structural and chassis parts of a motor vehicle.

20 Claims, No Drawings

ALUMINUM PRESSURE CASTING ALLOY

BACKGROUND OF THE INVENTION

The present invention relates to an aluminium alloy for components having increased strength with a yield point $Rp_{0.2}$>120 MPa and at the same time a high elongation at break A>7% in the cast state, a yield point $Rp_{0.2}$>200 MPa and at the same time an elongation at break A>6% after a T5 heat treatment or a yield point $Rp_{0.2}$>200 MPa and at the same time an elongation at break A>9% after a T6 heat treatment, in particular for structural parts and chassis parts of a motor vehicle.

Good flow and mould-filling properties and solidification characteristics are critical for structural components produced by a pressure casting process, in particular thin-wall components, and also when the pressure casting process is used for chassis parts. Thin-wall structural components are of particular interest in the automobile industry since these provide a weight advantage for the same component function as a result of lower materials usage, and this in turn reduces the operating costs and decreases environmental pollution.

The pressure casting technique now allows complicated components having a high strength and high elongation to be produced. Chassis parts are customarily manufactured in many places by other casting processes such as chill casting. The reason is that these components produced by the pressure casting process do not achieve the required strengths or do not achieve them at a satisfactory elongation in order to ensure reliable operation.

To achieve the required mechanical properties, especially a high ductility, a heat treatment, for example according to T6 (solution heat treated, quenched and aged hot) or T7 (solution heat treated, quenched and overaged), is usually carried out in the case of structural and chassis parts made of pressure casting alloys of the AlSi10MnMg type. This changes the cast microstructure of any component which then satisfies more demanding requirements in respect of strength and elongation at break. While an alloy of this type in the cast state has a yield point $Rp_{0.2}$ of about 110 MPa at an elongation at break A of 4-5%, an increase to above 150 MPa at not less than 7% elongation can be achieved by means of a T6 heat treatment. This is based on the strengthening effect of precipitation hardening in which the alloying elements Mg and Si participate. In addition, coalescence of the Si eutectic increases the ductility. Such a heat treatment is, for example, carried out as follows: a solution heat treatment in the temperature range from 450 to 535° C. is followed by quenching in water or in air to temperatures below about 100° C. As a result of the solution heat treatment, the alloying elements are homogeneously finely distributed due to diffusion processes and constrained in the α-Al by the quenching. In addition, the Si eutectic is spheroidized. The alloy now has a high ductility but only a low strength. As a result of the subsequent hot ageing at 150-250° C., fine uniformly distributed $Mg_2Si$ precipitates are formed and these in turn increase the strength of the material. Depending on the temperature profile of the T6 heat treatment, the mechanical properties can be optimized in terms of either strength or elongation at break, by which means a very wide property and thus product folio can be obtained from one alloy. To reduce production costs, a T5 heat treatment, i.e. hot ageing at 150-250° C. without prior solution heat treatment, can also suffice. Here too, the strength increase is due to formation of $Mg_2Si$ precipitates, but to a lesser extent since the quenching effect of a component taken from the casting tool is less pronounced and the proportion of magnesium forced to dissolve in the α-Al therefore also decreases.

Far higher strengths of up to 600 MPa for the yield point $Rp_{0.2}$ are achieved by mechanically alloyed AlZnMg and AlMgCu alloys because of their greater hardening potential. In these types of alloy, the strengthening effect is based on the precipitation hardening of the alloying elements Mg, Cu and Zn (W. Hufnagel et al., "Aluminium-Taschenbuch 14th edition", Aluminium-Verlag Düsseldorf, 1988, p. 46ff). However, owing to their susceptibility to hot cracks and their tendency to stick in the casting mould, these alloys are not suitable for pressure casting.

As further demands made of a structural or chassis part produced by a pressure casting process, mention may be made of, in addition to the demanding requirements in terms of strength and elongation, corrosion resistance, suitability for welding and life of the casting moulds. A further requirement is the dimensional stability of the components after heat treatment in order to be able to ensure problem-free assembly of the vehicle body.

Complicated solution heat treatments have, apart from additional economic costs for the heat treatment itself, the disadvantage that components tend to distort as a result of the sharp quenching, which can lead to further machining work and an increased reject rate.

It is an object of the invention to provide an aluminium pressure casting alloy which makes it possible, due to increased strength combined with high elongation, to make both structural and chassis components in a pressure casting process. This preferably includes chassis parts which, owing to the demanding mechanical requirements (e.g. yield point $Rp_{0.2}$>200 MPa at an elongation at break of A>6%) and the component geometry, tend to be produced by processes other than the pressure casting process. In addition, it is an object of the invention to ensure good castability and filling of the mould. Furthermore, the alloy should allow very many joining techniques, have high dimensional stability and have good corrosion resistance.

SUMMARY OF THE INVENTION

The object is achieved according to the invention by the aluminium alloy consisting of from 9 to 11.5% by weight of silicon, from 0.45 to 0.8% by weight of manganese, from 0.2 to 1% by weight of magnesium, from 0.1 to 1.0% by weight of copper, not more than 0.2% by weight of zinc, not more than 0.4% by weight of zirconium, not more than 0.4% by weight of chromium, not more than 0.3% by weight of molybdenum, not more than 0.2% by weight of iron, not more than 0.15% by weight of titanium, from 0.01 to 0.02% by weight of strontium and as balance aluminium and production-related impurities up to a total of not more than 0.5% by weight, as a result of which increased strengths combined with high elongation are ensured, both in the cast state and after heat treatment, for example after a T5, T6, T7 heat treatment or other known heat treatments. The hot ageing can also be carried out on the component within a further process step, for example a surface coating operation.

The achievement of the required quality, including in respect of strength and elongation, can be influenced greatly by the choice of alloy. The alloy composition according to the invention with the aim of increased strengths here has a target corridor for the yield point $Rp_{0.2}$>200 MPa and an elongation at break A>10%.

DETAILED DESCRIPTION

According to the invention, the alloy has a high hardening potential, which is utilized in hot ageing at temperatures in the range from 150 to 250° C. As a result of the development, it has been found that a significant strength-increasing effect without decreases in the elongation combined with satisfactory corrosion resistance is achieved by the addition of small amounts of copper or zinc. The desired effect is achieved by addition of from 0.1 to 1.0% by weight of copper, preferably from 0.15 to 0.5% by weight of copper (and more preferably from 0.3 to 0.5% by weight of copper) and up to 0.2% by weight of zinc. The addition of zinc also improves the casting behaviour and filling of the mould.

A combined addition of copper and zinc in the advantageous ratio within the abovementioned proportions allows a further increase in strength combined with satisfactory corrosion resistance.

The proportion of silicon in the alloy is from 9 to 11.5% by weight. The alloying-in of silicon reduces the shrinkage on solidification and thus assists good casting behaviour and good filling of the mould.

The addition of from 0.2 to 1.0% by weight of magnesium, preferably from 0.2 to 0.8% by weight of magnesium, has a strength-increasing effect caused by the above-described precipitation hardening. In addition, an addition in an advantageous ratio to copper decreases the susceptibility of the aluminium pressure casting alloy of the invention to corrosion.

An addition of zirconium brings about an increase in the elongation without an accompanying decrease in the strength since a finer eutectic microstructure is present as a result. The zirconium content of the pressure casting alloy of the invention is not more than 0.4% by weight. An addition of up to 0.3% by weight of molybdenum also increases the elongation without altering the strength. A combined addition of molybdenum and zirconium within the tolerances indicated further increases the elongation at break values achieved.

Formation of a coarse and acicular AlSi eutectic is avoided by addition of strontium. An addition of from 0.01 to 0.02% by weight of strontium modifies the eutectic in such a way that it forms a fine and more lamellar structure and also serves to avoid no upgrading and also overupgrading.

An addition of chromium brings about a further increase in the mechanical properties; the content of this is not more than 0.4% by weight, preferably not more than 0.3% by weight.

The combined content of manganese and iron significantly influences the life of the casting moulds and the demouldability. The desired effect is achieved by an addition of not more than 0.2% by weight of iron and a manganese content of from 0.45 to 0.8% by weight.

It is advantageous to keep the iron content low in order to avoid embrittlement of the material by formation of acicular AlFeSi phases in the microstructure. Simultaneous addition of manganese counters excessive attack by the low-iron melt on the casting mould and, by reducing the tendency to stick, improves the demouldability and thus the dimensional stability. However, in the case of a simultaneous addition of iron, manganese and chromium, it is necessary to set an advantageous ratio in order to avoid formation of gravity sediments since these have an adverse effect both on the flowability and the tendency to stick.

The addition of titanium brings about a decrease in the α-Al grain size by provision of nuclei during the formation of aluminium dendrites. The titanium content is not more than 0.15% by weight.

Further advantages and features of the novel aluminium alloy are revealed in the following examples, but the invention is not restricted to only the examples.

A number of specimen components in the form of a pressure-cast component and two spherical specimens were produced in a pressure casting process from two aluminium alloys having the following alloy compositions:

| | Alloy 1 | Alloy 2 |
|---|---|---|
| Si [% by wt.] | 10.9 | 10.5 |
| Fe [% by wt.] | 0.17 | 0.1 |
| Mn [% by wt.] | 0.45 | 0.46 |
| Cu [% by wt.] | 0.35 | 0.26 |
| Zn [% by wt.] | 0.07 | 0.1 |
| Mg [% by wt.] | 0.5 | 0.53 |
| Ti [% by wt.] | 0.08 | 0.12 |
| Cr [% by wt.] | 0.08 | 0.1 |
| Sr [% by wt.] | 0.014 | 0.014 |
| Mo [% by wt.] | 0.08 | 0.15 |
| Zr [% by wt.] | 0.13 | 0.15 |

After pressure casting, various heat treatments, both T5 and T6 as described, were carried out and tensile specimens were taken from the pressure-cast component. The measured values of the mechanical properties after these heat treatments and in the cast state are shown in the following table:

| | $Rp_{0.2}$ [MPa] | $R_m$ [MPa] | A [%] |
|---|---|---|---|
| Alloy 1 As cast | 147 | 306 | 7.9 |
| Alloy 1 T5 | 225 | 338 | 6.2 |
| Alloy 1 T6 | 262 | 363 | 9.3 |
| Alloy 2 As cast | 145 | 301 | 8.7 |
| Alloy 2 T5 | 223 | 332 | 6.4 |
| Alloy 2 T6 | 261 | 355 | 11.3 |

It can be seen from the table that specimens made of the alloys 1 and 2 have a yield point $Rp_{0.2}$>220 MPa combined with an elongation at break of A>6% after a T5 heat treatment and have a yield point $Rp_{0.2}$>260 MPa at an increased elongation at break of >9% after a T6 heat treatment. It is clear that the aluminium alloy of the invention is, in each case after heat treatment, particularly suitable for the production of crash- and strength-relevant chassis and structural parts of a motor vehicle by a pressure casting process. A yield point $Rp_{0.2}$ of >200 MPa combined with an elongation at break of >6% should be achieved in the production of chassis components of a motor vehicle by the pressure casting process. The abovementioned aluminium alloy makes it possible to produce such chassis components by the pressure casting process instead of other processes such as chill casting and sand casting which are customarily utilized for such parts, because of the increase according to the invention in the strength while maintaining the same high elongation.

Further studies have also shown the good corrosion resistance and weldability of such alloys.

The aluminium alloy of the invention is especially suitable for producing strength- and crash-relevant components of a motor vehicle.

The invention claimed is:

1. Aluminium alloy for cast components comprising:

an aluminium alloy composition comprising from 9 to 11.5% by weight of silicon, from 0.45 to 0.8% by weight of manganese, from 0.2 to 1.0% by weight of magnesium, from 0.15 to 0.5% by weight of copper, 0.07 to 0.2% by weight of zinc, 0.13 to 0.4% by weight of zirconium, not more than 0.4% by weight of chromium, 0.08 to 0.3% by weight of molybdenum, 0.1 to 0.2% by weight of iron, 0.08 to 0.15% by weight of titanium, from 0.01 to 0.02% by weight of strontium and as balance aluminium and production-related impurities up to a total of not more than 0.5% by weight; wherein, the aluminium alloy component in the as cast condition exhibits increased strength with a yield point $Rp_{0.2}$>120 MPa and at the same time an elongation at break A>7%; wherein the aluminium alloy component in the T5 heat treatment condition exhibits a yield point $Rp_{0.2}$>200 MPa and at the same time an elongation at break A>6%; and, wherein, the aluminium alloy component in the T6 heat treatment exhibits a yield point $Rp_{0.2}$>200 MPa and at the same time a high elongation at break A>9%.

2. Aluminium alloy according to claim 1, wherein the aluminium alloy comprises from 0.3 to 0.5% by weight of copper.

3. Aluminium alloy according to claim 1, wherein the aluminium alloy comprises from 0.2 to 0.8% by weight of magnesium.

4. Aluminium alloy according to claim 1, wherein the aluminium alloy comprises not more than 0.3% by weight of chromium.

5. Aluminium alloy according to claim 1, wherein the components comprise pressure casting of crash and strength-relevant structural and chassis components of a motor vehicle.

6. Aluminium alloy according to claim 4, comprising at least 0.08% by weight of chromium.

7. Aluminium alloy according to claim 1, wherein:

the molybdenum is effective to increase elongation without decreasing strength.

8. Aluminium alloy according to claim 7, wherein:

the zirconium is effective to increase elongation without decreasing strength.

9. Aluminium alloy according to claim 1, wherein:

the zirconium is effective to increase elongation without decreasing strength.

10. A method for using the aluminium alloy according to claim 1, the method comprising pressure casting.

11. A pressure cast component comprising the aluminium alloy according to claim 1.

12. A pressure cast component according to claim 11 having a lamellar structure.

13. Aluminium alloy for cast components comprising:

an aluminium alloy composition comprising from 9 to 11.5% by weight of silicon, from 0.45 to 0.8% by weight of manganese, from 0.2 to 1.0% by weight of magnesium, from 0.1 to 1.0% by weight of copper, 0.07-0.1% by weight of zinc, 0.13-0.15% by weight of zirconium, 0.08-0.1% by weight of chromium, 0.08-0.15% by weight of molybdenum, 0.1-0.17% by weight of iron, 0.08-0.12% by weight of titanium, from 0.01 to 0.02% by weight of strontium and as balance aluminium and production-related impurities up to a total of not more than 0.5% by weight; wherein, the aluminium alloy component in the as cast condition exhibits increased strength with a yield point $Rp_{0.2}$>120 MPa and at the same time an elongation at break A>7%; wherein the aluminium alloy component in the T5 heat treatment condition exhibits a yield point $Rp_{0.2}$>200 MPa and at the same time an elongation at break A>6%; and, wherein, the aluminium alloy component in the T6 heat treatment exhibits a yield point $Rp_{0.2}$>200 MPa and at the same time a high elongation at break A>9%.

14. Aluminium alloy according to claim 13, wherein the aluminium alloy comprises from 0.15 to 0.5% by weight of copper.

15. Aluminium alloy according to claim 13, wherein the aluminium alloy comprises from 0.3 to 0.5% by weight of copper.

16. Aluminium alloy according to claim 13, wherein the aluminium alloy comprises from 0.2 to 0.8% by weight of magnesium.

17. Aluminium alloy according to claim 13, wherein the aluminium alloy comprises not more than 0.3% by weight of chromium.

18. A method for using the aluminium alloy according to claim 13, the method comprising pressure casting.

19. A pressure cast component comprising the aluminium alloy according to claim 13.

20. A pressure cast component according to claim 19 having a lamellar structure.

* * * * *